US005856834A

United States Patent [19]

Murphy, III

[11] Patent Number: 5,856,834

[45] Date of Patent: Jan. 5, 1999

[54] DEVICE AND METHOD FOR CONSERVING INK CONSUMPTION IN AN INK CARTRIDGE OF A POSTAGE METER

[75] Inventor: Charles F. Murphy, III, Milford, Conn.

[73] Assignee: Pitney Bowes Inc., Stamford, Conn.

[21] Appl. No.: 764,291

[22] Filed: Dec. 12, 1996

[51] Int. Cl.[6] ..... B41J 2/165

[52] U.S. Cl. ..... 347/23

[58] Field of Search ..... 347/23, 30, 35, 347/36

[56] References Cited

U.S. PATENT DOCUMENTS

| | | | |
|---|---|---|---|
| 4,202,267 | 5/1980 | Heinzl et al. | 347/7 X |
| 4,926,196 | 5/1990 | Mizoguchi et al. | 347/23 |
| 4,965,596 | 10/1990 | Nagoshi et al. | 347/36 |
| 5,068,806 | 11/1991 | Gattan | 347/7 X |
| 5,132,711 | 7/1992 | Shinada et al. | 347/6 |
| 5,172,140 | 12/1992 | Hirabayashi et al. | 347/23 X |
| 5,365,312 | 11/1994 | Hillmann et al. | 347/6 X |
| 5,382,969 | 1/1995 | Mochizuki et al. | 347/23 |
| 5,414,452 | 5/1995 | Accatino et al. | 347/7 |
| 5,606,353 | 2/1997 | Mochizuki et al. | 347/23 |
| 5,663,750 | 9/1997 | Sakuma | 347/7 |

*Primary Examiner*—S. Lee

*Attorney, Agent, or Firm*—Steven J. Shapiro; Melvin J. Scolnick

[57] ABSTRACT

A postage meter includes a printhead for printing an indicia; a device for determining a total amount of ink consumed by the postage meter and for ascertaining when the total amount of ink consumed by the postage meter has exceeded a predetermined amount; and a controller having first structure for automatically performing maintenance on the printhead on a recurring basis in accordance with a normal maintenance program, and second structure, operative at times when the first structure determines that the total amount of ink consumed by the postage meter has exceeded the predetermined amount, for performing maintenance on the printhead in accordance with an ink conservation maintenance program instead of the normal maintenance program to reduce the quantity of ink consumed during maintenance of the printhead.

10 Claims, 4 Drawing Sheets

FIG. 3

| POSTAGE METER MAINTENANCE EVENT | POSSIBLE MAINTENANCE ACTIONS REQUIRED |
|---|---|
| MAINTENANCE AT POWER UP WITH BACK-UP BATTERIES INSTALLED | IF AT POWER UP THE PRINTHEAD IS CAPPED DEPENDING ON THE TIME ELAPSED SINCE THE LAST PURGING ACTION THE METER WILL EITHER PERFORM NO MAINTENANCE, A NORMAL PURGE, OR A POWER PURGE. IF UNCAPPED, THE METER WILL ENTER A ROUTINE THAT RESULTS IN NO MAINTENANCE ACTION OR A NORMAL PURGE OR A POWER PURGE DEPENDING ON THE TIME ELAPSED SINCE THE POWER WAS OFF |
| MAINTENANCE AT POWER UP WITH NO BACK-UP BATTERIES INSTALLED | IF PRINTHEAD IS CAPPED AT LEAST A TEST PRINT IS PERFORMED AND POSSIBLY A POWER PURGE DEPENDING ON THE TEST PRINT. IF UNCAPPED THE SAME POSSIBILITIES EXIST AS FOR THE INSTALLED BATTERY CONDITION |
| MAINTENANCE PRIOR TO PRINTING | DEPENDING ON THE TIME ELAPSED SINCE THE LAST FLUSH AND THE AMBIENT TEMPERATURE EITHER NO MAINTENANCE ACTION IS PERFORMED OR A NORMAL FLUSH, POWER FLUSH, OR A PLURALITY OF TYPES OF FLUSHES ARE PERFORMED |
| AFTER PRINTING AND WHEN PRINTHEAD IS CAPPED | DEPENDING UPON THE TIME ELAPSED SINCE THE LAST PRINT AND THE NUMBER OF TIMES THE PRINTHEAD HAS BEEN MOVED TO THE CAPPING POSITION, EITHER NO MAINTENANCE ACTION OCCURS OR A NORMAL PURGE IS PERFORMED |
| AUTOMATIC MIDNIGHT MAINTENANCE | THIS IS AN AUTOMATIC DAILY ROUTINE WHICH DEPENDING ON THE TIME SINCE A LAST PURGE AND THE CAPPED OR UNCAPPED POSITION OF THE PRINTHEAD, EITHER NO MAINTENANCE ACTION OCCURS OR A NORMAL PURGE OR A POWER PURGE MAY OCCUR |
| AUTOMATIC FLUSH INTO CAP | AT 12 HOURS AFTER LAST FLUSH, DEPENDING ON WHETHER PRINTHEAD IS CAPPED OR UNCAPPED, A NORMAL FLUSH IS PERFORMED |
| MAINTENANCE AT WAKE-UP | DEPENDING UPON WHETHER THE PRINTHEAD WAS CAPPED OR UNCAPPED EITHER NO MAINTENANCE IS PERFORMED OR A NORMAL OR POWER PURGE IS PERFORMED |
| USER INDUCED MAINTENANCE | USER CAN PERFORM A NORMAL PURGE OR UPON INSTALLATION OF A NEW PRINTHEAD THE METER AUTOMATICALLY PERFORMS AN INITIAL LOAD PURGE, OR UPON INSTALLATION OF A NEW INK CARTRIDGE THE METER AUTOMATICALLY PERFORMS A POWER PURGE |

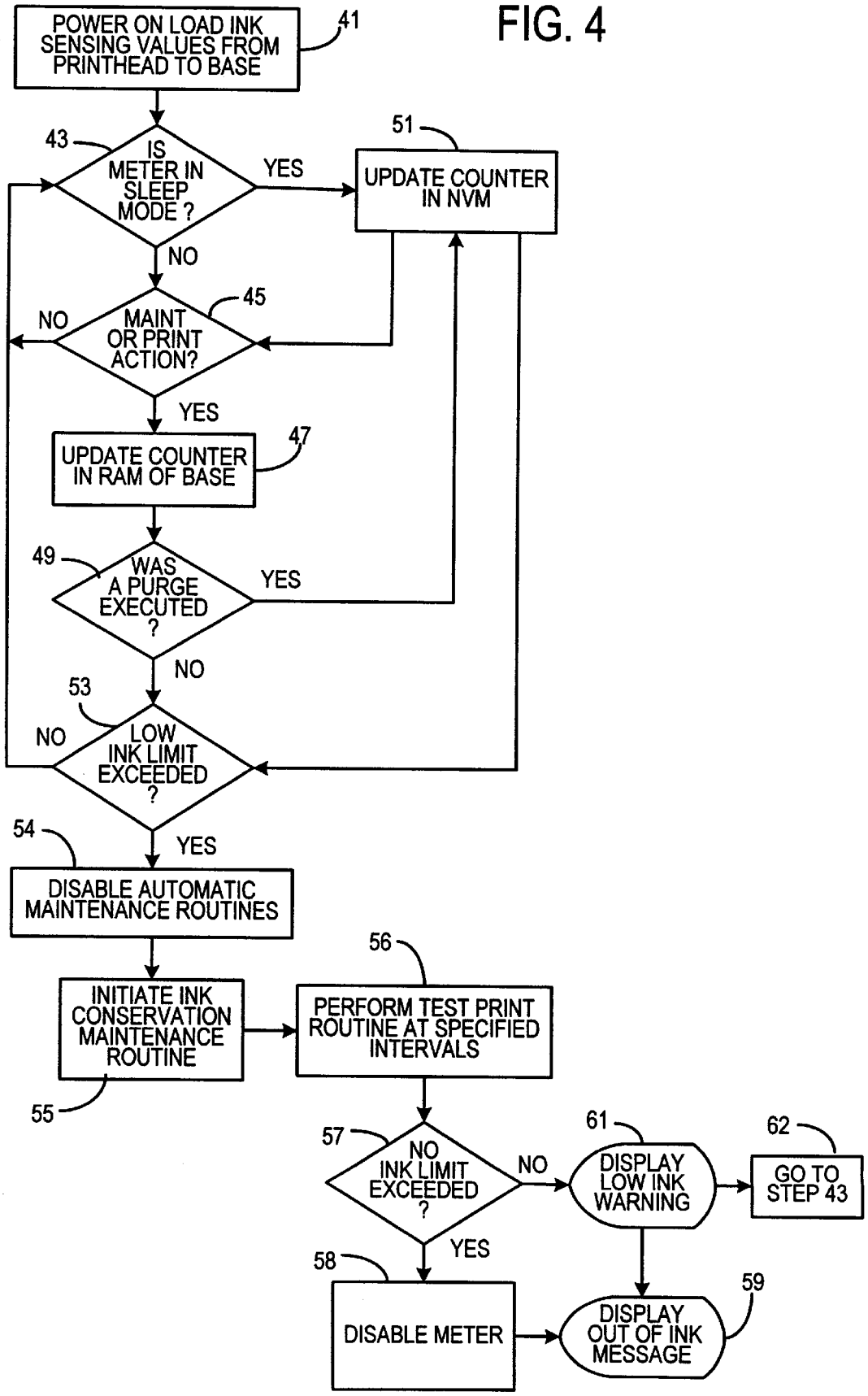
FIG. 4
POWER ON LOAD INK SENSING VALUES FROM PRINTHEAD TO BASE
41
43
IS METER IN SLEEP MODE ?
YES
NO
51
UPDATE COUNTER IN NVM
45
MAINT OR PRINT ACTION?
NO
YES
UPDATE COUNTER IN RAM OF BASE
47
49
WAS A PURGE EXECUTED ?
YES
NO
53
LOW INK LIMIT EXCEEDED ?
NO
YES
54
DISABLE AUTOMATIC MAINTENANCE ROUTINES
INITIATE INK CONSERVATION MAINTENANCE ROUTINE
55
56
PERFORM TEST PRINT ROUTINE AT SPECIFIED INTERVALS
57
NO INK LIMIT EXCEEDED ?
NO
YES
61
DISPLAY LOW INK WARNING
62
GO TO STEP 43
58
DISABLE METER
59
DISPLAY OUT OF INK MESSAGE

DEVICE AND METHOD FOR CONSERVING INK CONSUMPTION IN AN INK CARTRIDGE OF A POSTAGE METER

BACKGROUND

This invention is relates to a method and apparatus for conserving ink consumption in an ink cartridge, and more particularly, relates to a method and apparatus for reducing ink consumption during the maintenance of a printhead used in a postage meter when a predetermined low amount of ink remains in the printhead ink cartridge.

Digital printing apparatus utilizing known ink jet printing techniques typically have a source of supply ink which is used by a printhead for printing on a recording medium. Replacement or replenishment of the ink supply is periodically required in order to ensure that continued satisfactory printing occurs. In many prior art devices, the determination as to when the ink supply should be replaced or replenished was usually made by the operator when the images being printed began to appear light or spotty. This simple visual procedure proved quite satisfactory in a majority of applications such as typewriters, word processors, and computer printers, because if a document of unsatisfactory print quality was produced, the ink supply could be replenished or changed and the document reprinted with little impact to the user. However, in printing devices used, for example, in connection with scientific equipment or in facsimile machines, the failure by the printing device to produce a readable image and the corresponding loss of data associated therewith could present a significant problem for the user.

U.S. Pat. No. 5,068,806 addresses the problem associated with printing devices where the loss of image data is unacceptable. This patent describes an apparatus which counts every individual ink dot that is ejected by the printhead in printing the image data. The apparatus keeps a running total of the number of ink dots ejected by the printhead during printing and continuously compares this total to a predetermined number of ink dots. In the event that the running total exceeds the predetermined number, a message is provided to the operator advising that the ink supply is low and should be replaced.

Additionally, it is known from U.S. Pat. Nos. 4,202,267 and 5,131,711 to utilize either optical sensors or conductive electrodes in an ink supply structure. Each of these devices determines the amount of ink remaining in the ink supply structure and provides an indication when the ink level reaches a predetermined low level such that the ink supply can be replaced.

Copending U.S. application Ser. No. 08/701,897 entitled DEVICE AND METHOD FOR SENSING LOW INK LEVEL IN AN INK CARTRIDGE OF A POSTAGE METER and filed on Aug. 23, 1996 describes a method and apparatus utilized in a postage meter which counts the number of printed indicia and the types of maintenance actions required to be performed on the printhead as the basis for determining the level of ink remaining in the ink cartridge. When it is determined that a predetermined low amount of ink remains in the ink cartridge, a warning is given or the postage meter is disabled from operating until the ink cartridge is replaced.

In each of the above-described apparatus either 1) the ink cartridge is permitted to run out of ink without warning, 2) a warning is given at a low ink threshold but the ink cartridge is allowed to run out of ink if the operator does not timely replace the cartridge, or 3) when a low ink threshold is reached the apparatus is automatically disabled from further printing. In either of the first two situations, set forth above, where the ink cartridge is capable of running out of ink, permanent damage may occur to the printhead. That is, when the ink is depleted, automatic conventional printhead maintenance functions such as flushing or purging of the printhead can no longer be accomplished. If this situation occurs, the solvents in any reaming ink in the printhead nozzles may evaporate causing the remaining ink to dry out such that the printhead may become clogged and permanently damaged. This in turn requires replacement of the printhead which costs considerably more than the ink supply cartridge. In addition, in a postage meter, if the ink runs out during the printing of an indicia, the value of postage which should have been printed will be lost to the operator since accounting for the postage takes place prior to printing of the indicia.

In the event the apparatus is one that is prevented from further printing once the ink in the ink cartridge reaches a predetermined low level, damage to the printhead can be prevented assuming normal automatic printhead maintenance functions are maintained. However, the automatic shutdown of an apparatus in the middle of printing is often not desirable for the customer. For example, if the customer is in the middle of a significant production run they may prefer to continue printing even if the ink supply level is dangerously low. The automatic shut down of the apparatus takes any decision making flexibility out of the hands of the operator. Moreover, in an apparatus where automatic shutdown is desirable, the predetermined low level of ink at which point disablement occurs must have a safety factor built in such that a significant amount of ink is discarded when the cartridge is replaced. This cost is passed on to the customer because the ink cartridge needs to be replaced more often than the situation where the cartridge is permitted to be depleted of ink.

SUMMARY OF THE INVENTION

The applicant has recognized the competing goals of maximizing ink usage, providing user flexibility, and preventing printhead damage caused by depleting an ink supply and has developed a compromise solution which permits the life of the ink cartridge to be extended subsequent to the ink supply level reaching a dangerously low level through effective management of the automatic maintenance activities which are performed on the printhead.

The above object of extending the life of the ink cartridge subsequent to reaching a low ink supply level is accomplished by providing a postage meter that includes a printhead for printing an indicia; a device for determining a total amount of ink consumed by the postage meter and for ascertaining when the total amount of ink consumed by the postage meter has exceeded a predetermined amount; and a controller having first structure for automatically performing maintenance on the printhead on a recurring basis in accordance with a normal maintenance program, and second structure, operative at times when the first structure determines that the total amount of ink consumed by the postage meter has exceeded the predetermined amount, for performing maintenance on the printhead in accordance with an ink conservation maintenance program instead of the normal maintenance program to reduce the quantity of ink consumed during maintenance of the printhead.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 3 is a chart showing maintenance actions performed by the inventive postage meter; and FIG. 4 is a flow chart of an ink sensing program and an ink conservation maintenance program stored in the postage meter.

DETAILED DESCRIPTION OF THE PREFERRED EMBODIMENTS

Figure 1:
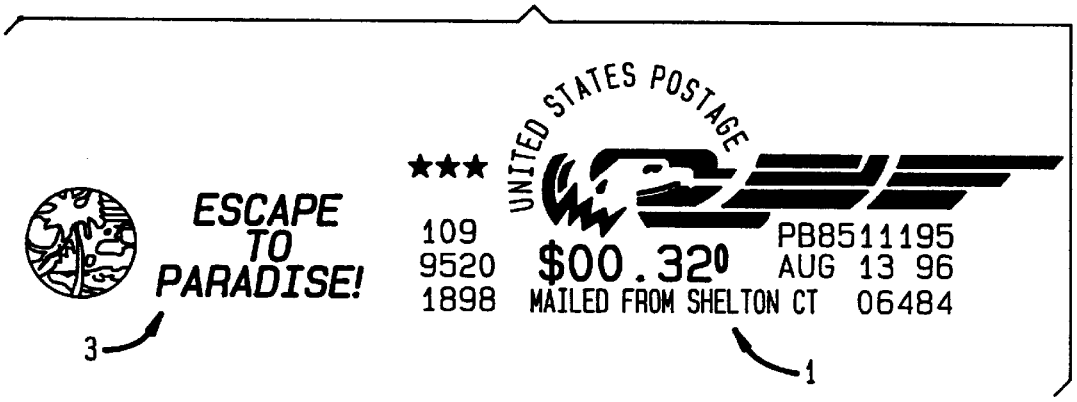
FIG. 1 shows an indicia printed by the inventive postage meter.

Referring to FIG. 1, there is shown a postage indicia 1 which is typical of those printed by known postage meters utilizing a digital printhead. The indicia 1 is substantially a fixed image except that certain data such as the postage value and the date are variable data which can change with each postage transaction. Additionally, immediately adjacent to the indicia 1 is an advertising slogan 3 which can be tailored to a particular meter user for their own business purposes. For the purpose of simplicity in this application, the term "indicia image" is utilized to encompass either an indicia 1 printed alone or an indicia 1 printed together with an advertising slogan 3. The indicia 1 and advertising slogan 3 jointly are contained within a readily defined space of approximately 1 by 4.5 inches. Accordingly, the total number of ink dots required to create the indicia image is substantially fixed such that the total ink dot variation between different postage transactions will only depend upon the variable data differences. Moreover, and as will be discussed in more detail below, the amount of ink consumed in producing the indicia image is significantly less than that consumed by the printhead maintenance functions such that the variations between indicia image ink drop counts can be ignored as being at noise level. Thus, in the inventive apparatus, a fixed ink dot count is associated with the printing of any indicia image. In the preferred embodiment this fixed ink dot count is based on an average ink dot count of the many indicia images that can be produced for different countries around the world.

Regarding the maintenance actions required to ensure that the postage meter nozzles remain unclogged, the two commonly known actions are flushing and purging. In a flushing maintenance action the printhead nozzles are fired a predetermined number of times into a spittoon or a maintenance cap to clear any clogged nozzles. In purging, a vacuum is applied to a maintenance cap which hermetically seals the printhead nozzles. The vacuum causes ink to be drawn through the nozzles from the ink supply and into a waste reservoir. Both the flushing and purging actions are well known in the art such that a further detailed description is not considered warranted for the purpose of understanding the instant invention.

The amount of ink consumed by the postage meter in printing an indicia image as compared to the amount of ink consumed for by various maintenance actions required for the printhead is set forth in the Table 1 below.

| ACTION | SOFTWARE COUNT | MILLILITERS OF INK CONSUMED |
|---|---|---|
| Print indicia and Advertising slogan | 3 | 0.001485 |
| Normal Flush | 1 | 0.000205 |
| Power Flush | 8 | 0.00164 |
| Power purge | 6,926 | 1.42 |
| Normal Purge | 1,609 | 0.33 |
| Initial Load | 11,819 | 2.42 |
| Low ink limit | 51,219 | 10.5 |
| No ink limit | 97,560 | 20 |

As the Table shows, all of the ink consumption values have been normalized as a software count relative to the normal flush maintenance count which itself has been given a software count of 1. Thus, for example, when a power purge is performed, 3,220 times as much ink is consumed as compared to that consumed for a normal flush and 1,073 times as much ink is consumed as compared to that consumed in printing an indicia/advertising slogan. The above software counts are used as described in more detail below in a software routine to determine both a low ink condition and an out of ink condition.

The enumerated ink consumption differences between similar maintenance actions is simply a matter of the number of times a specific action is done. For example, in a normal flush if a printhead having 64 nozzles which each produce an ink drop size of 50 picoliters is used, all of the nozzles are fired 64 times. However, if the power flush routine is exercised, each nozzle is fired 512 times. Similarly, during the operation of a priming pump, a normal purge extracts 0.33 ml of ink and a power purge simply is approximately four normal purges done sequentially to extract 1.42 ml of ink. The initial load is a one time special purge of the printhead when a meter is first received or when a new printhead is installed. The special purge extracts a preservation transport fluid which is contained in the printhead for shipping purposes and at the same time extracts a predetermined amount of ink. The low ink limit and the no ink limit identify threshold ink consumption values which when exceeded will respectively trigger the postage meter to display "low" and "out of ink" messages to the meter operator.

Figure 2:
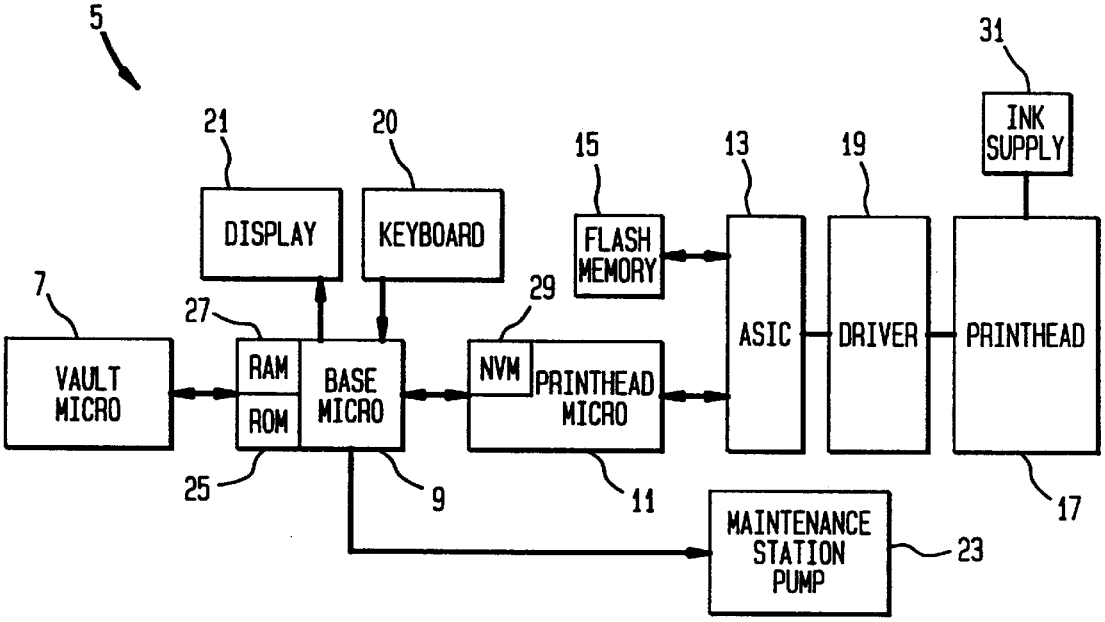
FIG. 2 is an electrical block diagram of the inventive postage meter.

FIG. 2 shows the basic schematic electrical block diagram of a postage meter 5 incorporating the instant invention. Postage meter 5 includes a vault microprocessor 7, a base microprocessor 9 and a printhead microprocessor 11. Vault microprocessor 7 performs funds accounting for the postage transactions while printhead microprocessor 11, in conjunction with ASIC 13 and Flash memory 15, initiate printing by ink jet printhead 17 via driver 19. Vault microprocessor 7 and printhead microprocessor 11 also perform a mutual authentication handshake prior to each postage transaction to ensure they are both authorized equipment. Base microprocessor 9 acts as a communication channel between vault microprocessor 7 and printed microprocessors 11, and also serves as a traffic cop in receiving user input from a keyboard 20 and relaying information to the operator via a display 21. More importantly, for the purposes if the instant invention, base microprocessor 9 activates the maintenance station pump 23 to perform the required purges of printhead 17 and initiates the flushing maintenance actions of printhead 19 via the printhead microprocessor 11 and the ASIC 13, all in accordance with maintenance routines that are stored in the base microprocessor ROM 25. ROM 25 also stores an ink sensing program and an ink conservation maintenance program which are each discussed in more detail below. Base microprocessor 9 also includes a working memory 27 (RAM), while printhead microprocessor 11 includes a nonvolatile memory 29, which in the preferred embodiment is a EEPROM. Furthermore, for the sake of completeness, an ink supply cartridge is shown at 31 and is mechanically releasably coupled to printhead 17 in a known manner. A more detailed discussion of the electronic architecture of postage meter 5 is described in copending U.S. patent application Ser. No. 08/554,179 which was filed on Nov. 6, 1995, which is incorporated herein by reference.

A summary of the maintenance routines that are stored in ROM 25 are shown in FIG. 3 and provide an appreciation for the complexity of the required maintenance operations and the frequency of their execution depending upon meter conditions (power on/off, printhead capped/uncapped), time elapsed after last purge or last flush or last print or straight time elapsed. As FIG. 3 clearly shows, the maintenance actions performed occur on a regular basis regardless of whether the meter is actually used for printing. All of the postage meter maintenance events except for the user induced events, are automatically executed by the maintenance routines stored in ROM 25. Accordingly, as previously discussed, due to the low usage of postage meter 5 for printing indicia images and the low amount of ink dots required to print the substantially fixed indicia image, a substantial amount of ink in the postage meter will be consumed by the regularly occurring maintenance activities. Moreover, as use of the meter for printing indicia images decreases the amount of ink consumed in maintenance as compared to printing increases.

Figure 5:
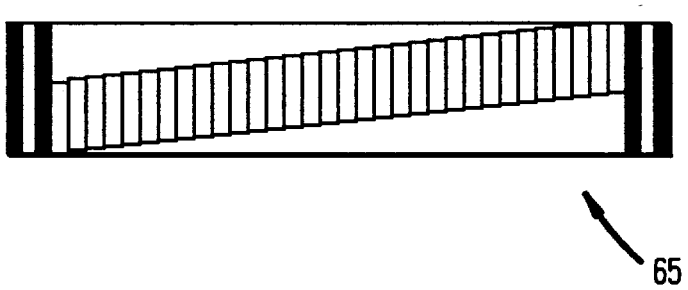
FIG. 5 shows a test pattern.
Figure 6:
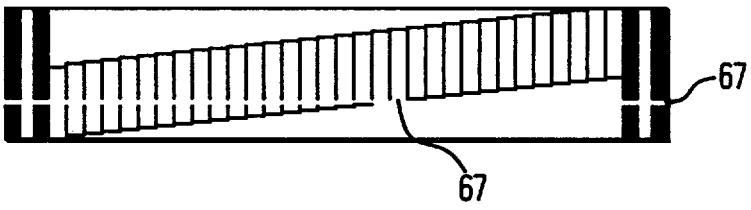
FIG. 6 shows an incomplete test pattern.

With reference to FIGS. 2 and 4, the inventive ink sensing apparatus and its operation will be described. Prior to the first use of postage meter 5, flash memory 15 has stored therein the weighting factors (software counts) for each maintenance action shown in Table 1, as well as the software count threshold values for the "low ink limit" and the "no ink limit". Upon installation of the meter for customer use, ASIC 13 downloads each of the above-mentioned counts into NVM 29. NVM 29 also has a counter therein which is updated periodically as discussed below to keep a combined running total of software counts for each maintenance and print action which occurs. When postage meter 5 is placed in a power on condition, the ink sensing program in ROM 25 (FIG. 4) reads the combined counter value and all of the individual software counts stored in NVM 29 into RAM 27, as shown in step 41. At step 43, a determination is made as to whether postage meter 5 has entered a "sleep mode" to conserve energy. Putting an electronic device into a sleep mode is well known in the art and in postage meter 5 it occurs if no printing has occurred for at least 10 minutes. If postage meter 5 is not in the sleep mode, the program moves to step 45 where it is determined if a maintenance or print action has occurred. If the answer is no, the program loops back to step 43. If however, a maintenance or print action has occurred, the total combined software counter register in RAM 29 is incremented by the count associated with the maintenance action(s) or print identified at step 47. The program, at step 49, then determines if a purge was executed and, if so, increments, at step 51, the total software count counter in NVM 29 by the software counts associated with the specific purging action. In the event a purge was not executed or after step 51, the program proceeds to step 53 and compares the total software count in the counter of RAM 27 with the low ink limit threshold value stored in RAM 27. If the low ink limit threshold value is not exceeded, the program returns to step 43. If however, the low ink limit threshold value is exceeded, the program proceeds to step 54 where a program stored in ROM 25 suspends operation of all of the automatic maintenance routines shown in FIG. 3. At step 55, ROM 25 executes an ink conservation maintenance program in lieu of the suspended automatic maintenance routines. In a preferred embodiment, the ink conservation maintenance program requires, at step 56, that the operator perform a test print routine each time a predetermined period of time has elapsed since the last indicia was printed. The test print routine requires the user to print a test pattern 65 shown in FIG. 5 which is selected via keyboard 20. If test pattern 65 has blank lines 67 in it as shown in FIG. 6, the operator will select to have a second test pattern printed and postage meter 5 will first perform a normal flush prior to printing the next test pattern. The operator can then either 1) keep printing test patterns to attempt to resolve the print problem, 2) can, on demand, select to perform any flush, print or purge procedure shown in table 1 to attempt to solve the print problem, or 3) can decide to replace the ink supply cartridge. In yet another embodiment, the test print process can be attempted three times, and if a good test pattern is not produced after the third try, the operator will be prompted to replace the ink supply cartridge 31.

By executing the ink conservation maintenance program in lieu of the automatic maintenance routines of FIG. 3, the consumption of ink due to maintenance functions is significantly reduced. That is, instead of expending ink in an automatically recurring preventive maintenance mode, the selection of when to perform a maintenance function is turned over to the operator once the low ink threshold has been exceeded. It will often be the case that minor printing problems can be corrected by a simple maintenance routine such as a normal flush as compared to a power purge. Under the automatic maintenance program, if due to time or some other criteria, a power purge was called for it would automatically be accomplished. In the ink conservation maintenance program unless there is a recognizable print problem, as determined by viewing the test print pattern, no maintenance is performed. Furthermore, even if a print problem is detected, it potentially can be resolved by the operator by first selecting a maintenance action that requires a minimal amount of ink consumption. It is therefore readily apparent to one possessing ordinary skill in the art that implementation of the ink conservation maintenance program will significantly extend the life of the ink cartridge by conserving ink consumption during printhead maintenance.

Referring back to FIG. 4, once the ink conservation matinee routine, including the test print program, has been implemented, the program moves to step 57 where it is determined if the total software count in RAM 27 exceeds the no ink limit threshold value. If it does, at step 58, the meter is disabled from performing all printing and maintenance actions and at step 59 display 21 shows an "out of ink" message which lets the operator know that the ink cartridge must be replaced. On the other hand, at step 57, if the no ink limit threshold value is not exceeded, then at step 61 display 21 shows a message indicating that the ink supply level is low and at step 62 returns to step 43.

Returning to step 43, if the answer to the inquiry is yes, the total ink dot counter in NVM 29 is updated with the total ink software counter value stored in RAM 27. Therefore, the counter in NVM 29 is only updated after any purge action or when the meter enters the sleep mode. This feature was added because the EEPROM used as NVM 29 has a finite number of times it can be written to. Accordingly, it was not desirable to update the counter in NVM 29 after every individual maintenance and print action.

While the preferred embodiment set forth above describes the ink conservation maintenance program as suspending all automatic maintenance functions and executing a test print program/user selected maintenance feature, this is only a representative method for conserving ink once a low ink threshold level has been exceeded. The inventive concept is meant to cover any modification to normally performed maintenance routines that will reduce ink consumption during the performance of those maintenance routines. For example, instead of suspending all automatic maintenance functions only a predetermined selected group of the functions may be suspended. Alternatively all or preselected ones of the automatic maintenance functions can have the time intervals or other event criteria associated with their respective execution changed so that they do not occur as frequently. Additionally, the amount of ink expended during a particular maintenance function can be changed to a lesser value such as, for example, reducing the count associated with a power flush to 4 versus the 8 shown in table 1. Once again, the common thread for each of these ink conservation maintenance programs is to reduce the amount of ink consumed during printhead maintenance subsequent to a predetermined low ink threshold level being exceeded. Therefore, in the context of this specification the term "ink conservation maintenance program" is intended to include any of the ink conservation methods discussed immediately above or any combination of such methods.

It is also important to note that in the preferred embodiment disablement of the meter occurs after the no ink limit is exceeded. However, in an alternative embodiment this feature can be eliminated allowing use of the meter until the ink supply is depleted. In either situation, implementation of the inventive ink conservation maintenance program will extend the effective use of the ink supply.

Additional advantages and modifications will readily occur to those skilled in the art. Therefore, the invention in its broader aspects is not limited to the specific details, and representative devices, shown and described herein. For example, while a postage meter has been described in the preferred embodiment, any type of value dispensing mechanism, such as, tax stamp machines, lottery machines, etc., could incorporate the invention. Moreover, the invention could include a further software routine to reset the counter when a new ink supply (cartridge) is replaced. Furthermore, the term "no ink" would include an extremely low ink condition but prior to the ink actually running out. Moreover, in the context of this application the means for determining the total amount of ink consumed by the postage meter includes the structure of the preferred embodiment as well as any of the prior art structures discussed herein. Accordingly, various modifications may be made without departing from the spirit or scope of the general inventive concept as defined by the appended claims.

What is claimed is:

1. A postage meter comprising:

a printhead for printing an indicia;

means for determining a total amount of ink consumed by the postage meter and for ascertaining when the total amount of ink consumed by the postage meter has exceeded a predetermined amount; and a controller having first means for automatically performing maintenance on the printhead on a recurring basis in accordance with a normal maintenance program, and second means, operative at times when the determining means determines that the total amount of ink consumed by the postage meter has exceeded the predetermined amount, for performing maintenance on a recurring basis on the printhead in accordance with an ink conservation maintenance program instead of the normal maintenance program to permit continued operation of the printhead and to reduce a quantity of ink consumed during the recurring maintenance of the printhead.

2. A postage meter as recited in claim 1, wherein the first means performs a plurality of different maintenance functions on the printhead in accordance with the normal maintenance program.

3. A postage meter as recited in claim 2, wherein the second means in accordance with the ink conservation maintenance program suspends performance of at least one of the plurality of different maintenance functions performed by the first means.

4. A postage meter comprising:

a printhead for printing an indicia:

means for determining a total amount of ink consumed by the postage meter and for ascertaining when the total amount of ink consumed by the postage meter has exceeded a predetermined amount;

a controller having first means for automatically performing maintenance on the printhead on a recurring basis in accordance with a normal maintenance program, and second means, operative at times when the determining means determines that the total amount of ink consumed by the postage meter has exceeded the predetermined amount, for performing maintenance on the printhead in accordance with an ink conservation maintenance program instead of the normal maintenance program to reduce a quantity of ink consumed during maintenance of the printhead;

wherein the first means performs a plurality of different maintenance functions on the printhead in accordance with the normal maintenance program;

wherein at least one of the plurality of different maintenance functions is performed by the first means each time a first predetermined period of time has elapsed since the at least one of the plurality of different maintenance functions was last performed by the first means, and the second means performs the at least one of the plurality of different maintenance functions each time a second predetermined period of time has elapsed since the at least one of the plurality of different maintenance functions was last performed by the second means.

5. A postage meter as recited in claim 4, wherein the second predetermined period of time exceeds the first predetermined period of time.

6. A postage meter as recited in claim 2, wherein a first quantity of ink is consumed during the performance of each of the plurality of different maintenance functions by the first means and the second means changes at least one of the different maintenance functions in accordance with the ink conservation maintenance program so that the at least one of the different maintenance functions consumes a second quantity of ink instead of the first quantity of ink each time it is performed by the second means, the second quantity of ink being less than the first quantity of ink.

7. A postage meter as recited in claim 2, wherein at least one of the plurality of different maintenance functions performed by the first means is initiated by the occurrence of a first specific event and the second means in accordance with the ink conservation maintenance program changes initiation of the performance of the at least one of the plurality of different maintenance functions by the first means to occur upon the occurrence of a second specific event instead of the first specific event, the second specific event occurring less often than the first specific event.

8. A method for conserving ink consumption in a value dispensing mechanism comprising the steps of:

printing on a recurring basis an indication of value utilizing a printing mechanism of the value dispensing mechanism;

determining a total amount of ink consumed by the value dispensing mechanism;

ascertaining when the total amount of ink consumed exceeds a predetermined amount;

prior to the total amount of ink consumed exceeding the predetermined amount automatically performing normal maintenance functions on a printhead of the value dispensing mechanism on a recurring basis; and subsequent to ascertaining that the total amount of ink consumed exceeds the predetermined amount, changing the normal maintenance functions which are automatically performed on the printhead so that less ink is consumed in performing the changed normal maintenance functions on a recurring basis as compared to the normal maintenance functions so that continued printing of the indication of value by the printing mechanism is maintained.

9. A method as recited in claim 8, wherein the normal maintenance functions are changed by reducing a frequency at which the normal maintenance functions are performed.

10. A method as recited in claim 8, wherein the normal maintenance functions include a plurality of different maintenance actions and the normal maintenance functions are changed by eliminating at least one of the plurality of different maintenance actions.

* * * * *